United States Patent [19]

Schwartz

[11] 4,160,402

[45] Jul. 10, 1979

[54] MUSIC SIGNAL CONVERSION APPARATUS

[76] Inventor: Louis A. Schwartz, 35 E. 9th St., Derby, Conn. 06418

[21] Appl. No.: 861,682

[22] Filed: Dec. 19, 1977

[51] Int. Cl.[2] ..... C10H 1/02

[52] U.S. Cl. ..... 84/1.24; 84/1.26

[58] Field of Search ..... 84/1.01, 1.11, 1.19–1.24, 84/1.25, 1.26, 1.27; 332/17, 27; 323/17, 119, 121

[56] References Cited

U.S. PATENT DOCUMENTS

| | | | |
|---|---|---|---|
| 3,465,087 | 9/1969 | Brand et al. | 84/1.26 |
| 3,569,603 | 3/1971 | Kern | 84/1.19 |
| 3,629,484 | 12/1971 | Suzuki | 84/1.25 |
| 3,746,774 | 7/1973 | Adachi | 84/1.22 |
| 3,762,265 | 10/1973 | Adachi | 84/1.24 |
| 3,809,791 | 5/1974 | Uchiyama | 84/1.24 |

OTHER PUBLICATIONS

"Experimenting With Electronic Music," Robert Brown & Mark Olson, pp. 95–100.

*Primary Examiner*—Vit W. Miska
*Attorney, Agent, or Firm*—Jack D. Slobod

[57] ABSTRACT

Apparatus for converting the relatively rapid rise time, relatively long fall tone envelopes of a music source output to envelopes having relatively long rise time and relatively rapid fall time and for also varying the frequency of the tone in the nature of the Doppler effect of an accellerating source provides the modulation input to cascaded phase and amplitude modulators fed by the music source.

4 Claims, 5 Drawing Figures

MUSIC SIGNAL CONVERSION APPARATUS

FIELD OF THE INVENTION

The present invention relates generally to apparatus for producing unusual audio effects and is an improvement to my previous invention on which an application for patent was filed Nov. 10, 1975 resulting in U.S. Pat. No. 4,003,285 issued Jan. 18, 1977. In its particular aspects, the present invention relates to a device for simultaneously modulating the phase and amplitude of a music signal with a sawtooth signal to produce apparent time reversal and source accelleration effects.

BACKGROUND OF THE INVENTION

A musical note or tone produced by a musical instrument of string, piano or percussion types is characterized by an envelope having a relatively rapid rise time and a relatively slow, usually exponential, fall or decay time. If an insolated musical note signal of the aforementioned type were recorded, as with a tape recorder and then played backwards, there would result a highly unusual and pleasing note signal having a slow rise and a rapid decay. Of course, however, music is composed of a sequence of notes and playing a prerecorded musical program backwards would yield the sequence of notes in backwards order. Similarly, if this recorder and its associated speaker were in motion and were accellerating toward the listener, the apparent frequency of a note signal would steadily increase during the duration of the signal. This latter effect would also occur if the playback speed of the recording were steadily increasing.

PRIOR ART STATEMENT

Applicant represents that the following are the closest relevant prior art of which he is aware:

a. U.S. Pat. No. 4,003,285 issued Jan. 18, 1977 to the applicant herein;

b. U.S. Pat. No. 3,629,484 issued Dec. 21, 1971 to Shoichi Suzuki (cited in file of U.S. Pat. No. 4,003,285 to applicant;

c. "Experimenting with Electronic Music" by Robert Brown and Mark Olsen, copyright 1974, pages 95–100 (cited in file of U.S. Pat. No. 4,003,285 to applicant);

d. "Solid State Devices and Applications" by Frederick F. Driscoll and Robert F. Coughlin, 1975, Prentiss Hall, publisher, pages 296–297 (copy submitted herewith);

Applicant's prior patent as well as the cited passages of "Experimenting with Electronic Music" disclose apparatus for converting the envelope of a music signal to one appearing to be time reversed. The frequency of the music signal is unchanged.

Suzuki discloses a tremulo effect generator in which a music signal is added to an amplitude modulated phase-shifted version of the same signal. The modulation is of a low frequency sinusoidal type and the phase shift is constant rather than varied.

"Solid State Devices and Applications" discloses a voltage controlled sawtooth oscillator forming a portion of the disclosed perferred embodiment of the invention.

OBJECTS OF THE INVENTION

It is an object of the present invention to provide apparatus for simultaneously converting relatively rapid rise time, relatively slow fall time envelopes of musical note signals to envelopes having a relatively slow rise time and a relatively rapid fall time and for varying the frequency of the musical note as if it were coming from an accelerating source.

It is a further object of the present invention to provide cascaded phase and amplitude modulators fed by a music source with each modulator being driven by the same sawtooth modulating signal.

SUMMARY OF THE INVENTION

Briefly, the aforementioned and other objects of the present invention are satisfied by providing an apparatus having a input port for coupling to a source of music signal. The input port feeds cascaded phase and amplitude modulators which in turn feed an output port for driving a speaker. Each modulator has a modulation input terminal fed by the output of a sawtooth relaxation oscillator. The sawtooth output signal of the oscillator has a relatively slow rise time and relatively rapid fall time and while the envelope of each individual note signal from the music source has opposite rise and fall characteristics to the sawtooth signal, the result of the effective multiplication of the sawtooth and input music signal envelopes in the amplitude modulator creates note signals at the amplitude modulator output having slow rise time and rapid fall time. Consequently, each individual note signal from the music source is modified as if it were individually recorded and played back in time reversed form. However, the sequence of the note signals is unchanged. Further, the application of the sawtooth signal to the phase modulator causes the frequency of the note signal to be generally increasing as if it were coming from a source accellerating toward the listener.

Other objects, features and advantages of the present invention will become apparent upon perusal of the following detailed description of the preferred embodiment of the present invention when taken in conjunction with the appended drawing.

DETAILED DESCRIPTION OF THE PREFERRED EMBODIMENT

Figure 1:
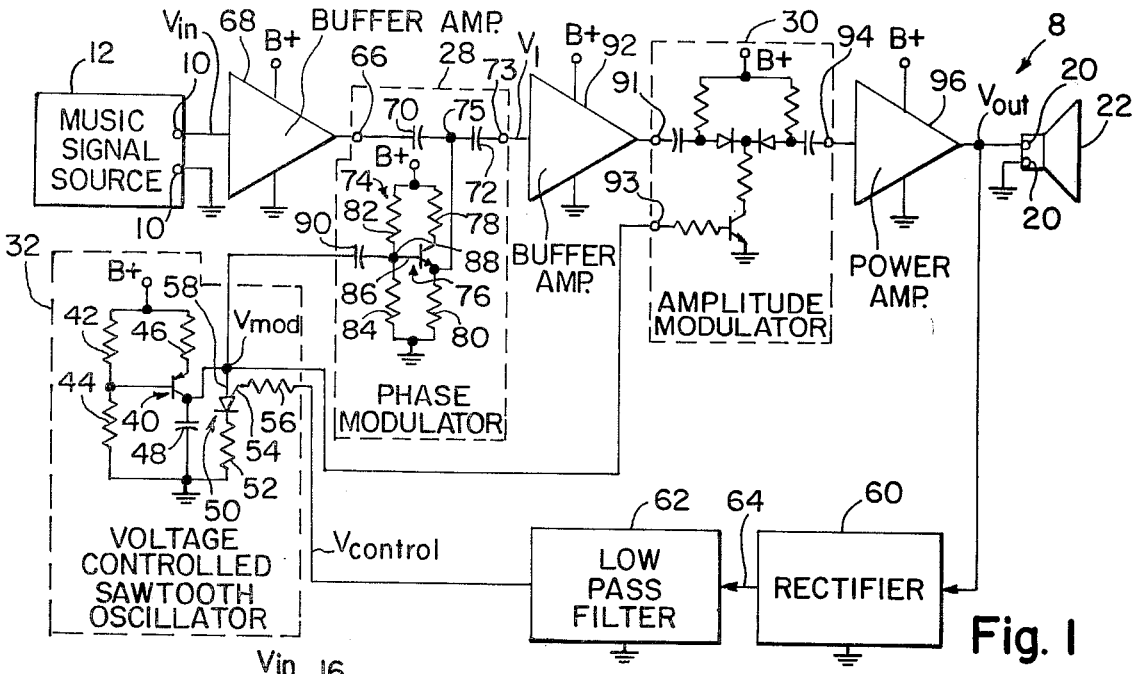
FIG. 1 is a block diagram and partial schematic of the music signal conversion apparatus of the present invention, in which the location of voltage signals $V_{in}$, $V_1$, $V_{out}$ and $V_{mod}$ are indicated.
Figure 2A:
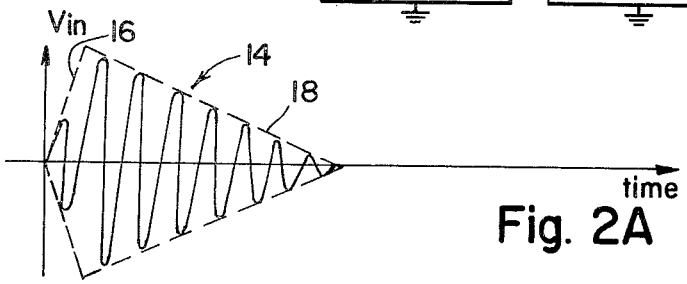
FIGS. 2A, 2B, 2C and 2D are aligned plots versus time respectively of the voltage signals $V_{in}$, $V_l$, $V_{out}$ and $V_{mod}$.

Referring to FIG. 1 of the drawing, the music signal conversion apparatus 8 of the present invention includes an input port, consisting of terminals 10 adapted to be coupled to a music signal source 12. Source 12 provides a music input signal $V_{in}$ as produced by musical instruments of the string, piano or percussion types. $V_{in}$ includes A.C. note signals 14, typically plotted versus time in FIG. 2A, which have envelopes characterized by a relatively rapid rising leading portion 16 and relatively slowly falling trailing portion 18. Note signals 14 are also characterized by being generally constant in frequency.

Figure 2B:
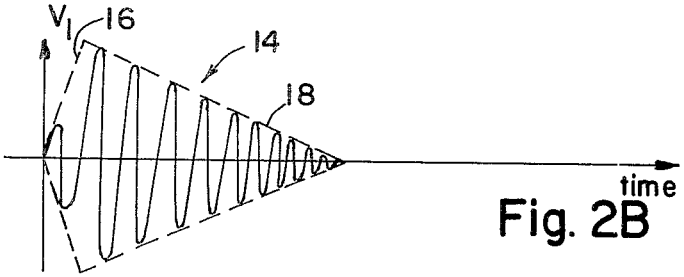
Figure 2C:
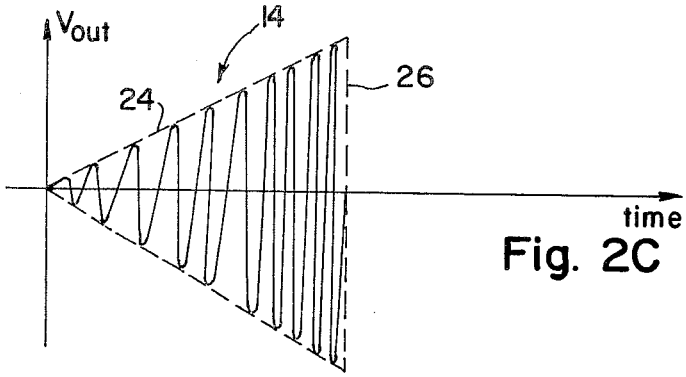

Apparatus 8 further has an output port, consisting of terminals 20, which is adapted to drive a speaker 22 with an output music signal $V_{out}$, typically plotted versus time in FIG. 2C, in which note signals 14 are modified to have an envelope including a relatively slowing rising leading portion 24 and a relatively rapidly falling trailing portion 26. Consequently, each individual note signal 14 at the output port (terminals 20) appears to be time reversed from the note signal 14 at the input port (terminals 10). Further, the frequency of the $V_{out}$ note signal 14 is generally steadily increasing over the duration of the note signal, whereas the frequency of the $V_{in}$ note signal 14 is generally constant. This latter effect will appear to be a Doppler effect and will give the listener of the audible $V_{out}$ note signal from speaker 22 the impression that the source of sound is accellerating towards him.

Figure 2D:
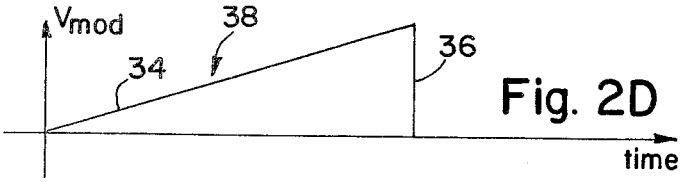

These unusual effects are accomplished by forming $V_{out}$ by serially passing the input signal, $V_{in}$, through a phase modulator 28 and an amplitude modulator 30 with each modulator being controlled by the output signal, $V_{mod}$, from a sawtooth relaxation oscillator 32. $V_{mod}$, which is typically plotted versus time in FIG. 2D, is characterized by a generally linerally rising leading portion 34 and a relatively rapdily falling trailing portion 36. The order of the phase modulation and amplitude modulation operations is not critical, it is only necessary that the phase and amplitude modulators are in a cascade relationship to each other. Furthermore, with some modification of modulation signal, a frequency modulator might be substituted for phase modulator 28. It is convenient to consider the phase modulator 28 and amplitude modulator 30 as a single means for simultaneously modulating phase and amplitude in accordance with the same modulation input signal $V_{mod}$.

The sawtooth relaxation oscillator 32 is preferably of the voltage controlled type in order that $V_{mod}$ be nearly synchronous with note signals 14. Therefore, it is desired that each sawtooth shaped pulse 38 of $V_{mod}$ commence nearly simultaneously with each note signal 14 and be of duration of the same or just somewhat longer than the note signal. Further, it is desired that the slope of the rising portion 34 of $V_{mod}$ be constant. This is accomplished by utilizing substantially the circuit as disclosed in "Solid State Devices and Applications" by Frederick F. Driscoll and Robert F. Coughlin, 1975, published by Prentiss Hall. Therein, a PNP transistor 40 is biased by resistors 42, 44, and 46 so as to provide a substantially constant current source for charging a capacitor 48. A PUT 50 in series with current limiting resistor 52 is provided shunting capacitor 48. The capacitor voltage at which PUT 50 conducts to discharge the capacitor, is controlled by the voltage signal $V_{control}$ applied to the PUT gate electrode 54 via resistor 56 in series therewith. The signal $V_{mod}$ is taken from the anode 58 of PUT 50. At a very low value of $V_{control}$, PUT 50 may be of such short duration as to have virtually zero maximum voltage. As $V_{control}$ increases in amplitude the duration of pulse 38 increases. To control oscillator 32, to have the desired duration or period, $V_{out}$ is fed to a rectifier 60, whose output feeds the input of a low pass filter 62 via line 64. The output of filter 62 provides the signal $V_{control}$. Filter 62 is preferably of a short time constant so that $V_{control}$ somewhat increases during each note signal 14 and fall at the end of the note signal.

The use of constant current charging of capacitor 48 is not essential and in fact other pleasing effects may be possible by varying the slope of $V_{mod}$ by appropriate circuitry.

$V_{in}$ is preferably fed to the signal input terminal 66 of phase modulator 28 via a buffer amplifier 68. Phase modulator 28 generally comprises an effective Tee network including a pair of series capacitors 70 and 72 directed from input terminal 66 to the output terminal 73 of modulator 28. An active network 74 forms a modulated resistance directed from the junction 75 between the capacitors 70, 72 and ground. Network 74 includes an NPN transistor 76 having a collector resistor 78 directed to B+ an an emitter resistor 80 directed to ground. The base electrode 86 of transistor 76 is connected to the junction 88 of resistors 82, 84. Anode 58 of PUT 50 is A.C. coupled to junction 88 via capacitor 90 in order to supply the signal $V_{mod}$ thereto. As the signal $V_{mod}$ increases, the A.C. resistance of active network 74 decreases so as to increase the phase advance introduced by phase modulator 28. The output of phase modulator 28 is denominated as $V_1$ and is typically plotted versus time in FIG. 2B. It will be noted that while $V_1$ has substantially the same envelope as $V_{in}$, its frequency varies and generally increases particularly in the latter half of note signal 14. This emphasis in the latter half of the note signal is believed due to A.C. coupling to $V_{mod}$ to active network 74, where when the note signals 14 rapidly repeat, the early portion of each $V_{mod}$ pulse 38 may be of negative voltage at junction 88.

The signal $V_1$ is applied to the input terminal 91 of amplitude modulator 30 via buffer amplifier 92 and $V_{mod}$ is applied to the modulator input terminal 93 of modulator 30. The output terminal 94 of modulator 30 is coupled to the output port (terminals 20) via power amplifier 96. The operation of amplitude modulator 30 is fully discussed in my prior patent, U.S. Pat. No. 4,003,285, granted Jan. 18, 1977, which discussion is hereby incorporated herein by reference. Amplitude modulator 30 effectively multiplies the signals $V_1$ and $V_{mod}$ to produce the signal $V_{out}$, which is characterized by the relatively slowly rising leading envelope portion 24 and the realtively rapidly falling trailing envelope portion 26, in the nature of a time reversal effect. Further $V_{out}$ retains the generally increasing frequency characteristic of $V_1$ which is in the nature of a source accelleration Doppler effect.

It will now be appreciated that the objects of the present invention, namely the provision of the dual effects of apparent time reversal and apparent source accelleration have been satisfied in the perferred embodiment of the present invention detailed herein. It should be noted that numerous modifications and omissions in the details thereof are possible within the intended spirit and scope of the invention.

What is claimed is:

1. Apparatus for converting an input music signal composed of note signals of generally constant frequency having envelopes characterized by a relatively rapid rise time and a relatively slow fall time to an output music signal composed of note signals having a frequency generally constantly increasing over the duration of each note signal and having envelopes characterized by a relatively slow rise time and a relatively rapid fall time, said apparatus comprising: an input port adapted to be coupled to a source for said input music signal; an output port; and modulator means having an input terminal coupled to said input port for simultaneously modulating both the amplitude and phase of said input music signal in accordance with a modulation signal, said modulator means having an output terminal coupled to said output port; oscillator means for generating a modulation signal of sawtooth shape; said oscillator means being coupled to said modulator means for supplying said modulation signal thereto, said modulator means being configured to convert said input music signal to said output music signal in response to said modulation signal.

2. The apparatus of claim 1, wherein said modulator means comprises cascaded phase and amplitude modulators, said oscillator means being coupled to supply said sawtooth modulation signal to each of said modulators, said phase modulator being configured to operate on said input music signal in response to said modulation signal so as to generally constantly increase the frequency of each note signal during the duration of each note signal and said amplitude modulator being configured to operate on said input music signal in response to said modulation signal so as to convert the envelopes of each note signal characterized by relatively rapid rise time and relatively slow fall time to envelopes characterized by relatively slow rise time and relatively rapid fall time.

3. The apparatus of claim 1, wherein said oscillator means has an input control terminal and comprises means for generating a periodic signal of sawtooth shape having a period generally in proportion to the voltage at said input control terminal; rectifier means having an input terminal fed by said output port and having an output terminal; low pass filter means having an input terminal coupled to the output terminal of said rectifier means; said low pass filter means having an output terminal coupled to the input control terminal of said oscillator means.

4. The apparatus of claim 2, wherein said oscillator means has an input control terminal and comprises means for generating a periodic signal of sawtooth shape having a period generally in proportion to the voltage at said input control terminal; rectifier means having an input terminal fed by said output port and having an output terminal; low pass filter means having an input terminal coupled to the output terminal of said rectifier means; said low pass filter means having an output terminal coupled to the input control terminal of said oscillator means.

* * * * *